US012096804B2

(12) United States Patent
Reid et al.

(10) Patent No.: US 12,096,804 B2
(45) Date of Patent: Sep. 24, 2024

(54) STAIN RESISTANT COLLAR PROTECTORS

(71) Applicants: Tyrone A. Reid, Suwanee, GA (US); Tanthia F. Reid, Suwanee, GA (US)

(72) Inventors: Tyrone A. Reid, Suwanee, GA (US); Tanthia F. Reid, Suwanee, GA (US)

( * ) Notice: Subject to any disclaimer, the term of this patent is extended or adjusted under 35 U.S.C. 154(b) by 184 days.

(21) Appl. No.: 16/678,999

(22) Filed: Nov. 8, 2019

(65) Prior Publication Data

US 2020/0187569 A1 Jun. 18, 2020

Related U.S. Application Data

(60) Provisional application No. 62/779,608, filed on Dec. 14, 2018.

(51) Int. Cl.
*A41B 3/18* (2006.01)

(52) U.S. Cl.
CPC ..... *A41B 3/18* (2013.01)

(58) Field of Classification Search
CPC ..... A41B 3/18
USPC ..... 2/60
See application file for complete search history.

(56) References Cited

U.S. PATENT DOCUMENTS 1,526,324 A * 2/1925 Dormandy ..... A41B 3/00 2/131
1,556,468 A * 10/1925 Alamo ..... A45D 44/08 2/50
1,766,259 A * 6/1930 Payne ..... A41B 5/00 2/131
1,768,384 A * 6/1930 Villasenor ..... A41D 27/16 2/60
2,053,564 A * 9/1936 Knopp ..... B65D 85/182 223/83
2,110,544 A * 3/1938 Dauphin ..... A45D 44/08 2/50
2,116,685 A * 5/1938 Nicolet ..... A45D 44/08 2/50
2,164,751 A * 7/1939 Newman ..... A41B 3/04 2/139
2,233,477 A * 3/1941 Hilberg ..... A41B 3/10 442/214
2,246,035 A * 6/1941 Elliot ..... A45D 44/08 2/50
2,275,098 A * 3/1942 Welch ..... B65D 85/182 223/83
2,303,782 A * 12/1942 Yaghubian ..... A41D 15/005 2/98
2,500,985 A * 3/1950 Goetz ..... A41B 3/02 2/127
2,514,646 A * 7/1950 Johnson ..... A41D 27/18 2/60
2,518,300 A * 8/1950 Fine, Sr. ..... B65D 85/182 223/83

(Continued)

*Primary Examiner* — Jocelyn Bravo
(74) *Attorney, Agent, or Firm* — SMITH, GAMBRELL & RUSSELL, LLP.

(57) ABSTRACT

A stain resistant shirt collar protector is described herein. The stain resistant shirt collar protector is formed having a longitudinal fold line configured to engage a collar fold line. The longitudinal fold line terminates in oblique ends configured to align with edges of the shirt collar. Furthermore, different forms of adhesives and materials may be used to form the stain resistant shirt collar protector, as described in detail herein.

4 Claims, 5 Drawing Sheets

(56) References Cited

U.S. PATENT DOCUMENTS 2,587,491 A * 2/1952 Less ..... A41B 3/06 2/132
2,633,576 A * 4/1953 Powers ..... A41D 27/16 2/60
2,634,420 A * 4/1953 Jackson ..... A41D 27/16 2/60
2,637,034 A * 5/1953 Smith ..... A41D 27/16 2/60
2,655,295 A * 10/1953 Ransom ..... A41B 3/06 223/83
2,720,348 A * 10/1955 Strasser ..... A41B 3/18 223/83
2,885,682 A * 5/1959 Koenig ..... A41B 3/04 2/124
2,920,328 A * 1/1960 Hammersley ..... A41D 27/18 2/98
3,022,514 A * 2/1962 Kaiser ..... F04C 14/02 2/60
3,041,626 A * 7/1962 Light ..... A41B 5/00 2/131
3,213,464 A * 10/1965 Lewis ..... A41D 13/04 2/50
3,651,519 A * 3/1972 Glick ..... A41B 3/00 2/132
3,860,967 A * 1/1975 Tedesco ..... A41B 3/00 2/129
4,008,494 A * 2/1977 Hicks ..... A41D 27/16 2/60
4,190,903 A * 3/1980 Kinsella ..... A45D 44/08 2/60
4,651,347 A * 3/1987 Brown ..... A41D 27/16 2/60
4,653,119 A * 3/1987 Kaiser ..... A41B 3/18 2/60
4,953,232 A * 9/1990 Gaines ..... A41B 3/18 2/131
4,980,927 A * 1/1991 Wawiluk ..... A45D 44/08 2/129
4,989,269 A * 2/1991 Takasugi ..... A41B 3/18 2/116
D324,766 S * 3/1992 Bacchus ..... D2/860
5,572,740 A * 11/1996 Geniesse ..... A45D 44/08 2/46
5,575,410 A * 11/1996 Compton ..... A41B 3/18 206/297
5,711,030 A * 1/1998 Anderson ..... A41D 27/16 2/139
5,749,098 A * 5/1998 Evans ..... A41D 19/0041 2/123
5,940,882 A * 8/1999 Auguste ..... A41D 27/16 2/60
5,956,769 A * 9/1999 Stepney ..... A41B 1/00 2/129
5,991,919 A * 11/1999 Baggetto ..... A41B 13/10 2/49.1
6,094,744 A * 8/2000 Dibenedetto ..... A45D 44/08 2/50
6,105,166 A * 8/2000 Thomas, III ..... A41D 27/16 2/132
6,427,241 B1 * 8/2002 Manno ..... A45D 44/08 2/181
6,430,747 B1 * 8/2002 Lee ..... A41B 7/00 2/123
D490,213 S * 5/2004 Osuagwu ..... D2/602
6,836,901 B2 * 1/2005 Hippensteel ..... A42C 5/02 2/54
7,065,791 B1 * 6/2006 Harris ..... A45D 44/08 2/50
7,080,413 B1 * 7/2006 Schneider ..... A41D 27/16 2/50
7,506,383 B2 * 3/2009 Chard ..... A41D 27/16 2/50
7,770,236 B2 * 8/2010 Gulisano ..... A41B 3/04 2/98
7,941,868 B1 * 5/2011 Shaw ..... A45D 44/08 2/50
9,015,865 B2 * 4/2015 Siragusa ..... A41B 3/00 2/129
9,332,788 B2 * 5/2016 Jelveh ..... A43B 3/08
D828,978 S * 9/2018 Kwon ..... D2/860
10,314,381 B1 * 6/2019 Silva ..... A45D 44/08
10,433,591 B2 * 10/2019 Gilde ..... A41B 3/18
11,154,097 B2 * 10/2021 Frankel ..... A41B 3/06
2003/0093850 A1 * 5/2003 Peterkin ..... A41D 27/16 2/60
2004/0148678 A1 * 8/2004 Spears ..... A41B 3/18 2/129
2006/0021108 A1 * 2/2006 Lomas ..... A41B 3/18 2/129
2007/0039084 A1 * 2/2007 Chard ..... A45D 44/02 2/50
2008/0229472 A1 * 9/2008 Maggs ..... A41B 3/18 2/60
2008/0244804 A1 * 10/2008 Lawrence ..... A41D 27/12 2/53
2008/0301848 A1 * 12/2008 Smith ..... A41B 3/18 2/60
2010/0199401 A1 * 8/2010 Whitfield ..... A41D 27/16 2/60
2010/0287678 A1 * 11/2010 Myers ..... A41D 27/145 2/60
2011/0296579 A1 * 12/2011 Galvan ..... A42C 5/02 2/60
2013/0269078 A1 * 10/2013 Andrade ..... D06F 59/02 2/69
2014/0041093 A1 * 2/2014 Korobkin ..... A41D 27/16 2/60
2014/0259262 A1 * 9/2014 Schreiber, Sr. ..... A41B 3/18 2/46
2015/0007373 A1 * 1/2015 Martin ..... A41B 7/12 2/60
2015/0026860 A1 * 1/2015 Tsui ..... A41B 3/18 2/46
2015/0033436 A1 * 2/2015 Peleg ..... A41B 3/18 2/60
2015/0096096 A1 * 4/2015 Jelveh ..... A41B 3/14 2/60
2016/0135508 A1 * 5/2016 Lawrence ..... A41B 3/18 2/129
2018/0263297 A1 * 9/2018 Gilde ..... A41B 3/18
2019/0382188 A1 * 12/2019 Hobbs ..... A41B 3/18

* cited by examiner

STAIN RESISTANT COLLAR PROTECTORS

CROSS-REFERENCE TO RELATED APPLICATIONS

This application is based on provisional application No. 62/779,608 filed Dec. 14, 2018, to which priority is claimed. The contents of the application are expressly incorporated herein by reference.

BACKGROUND OF THE INVENTION

Field

The present subject matter relates generally to shirt collars and, in particular, to stain resistant protectors for shirt collars.

Background

Numerous protective covers for dress shirt collars have been designed to limit direct contact between a wearer's neck and the inner surface of a dress shirt collar. Consider U.S. Pat. Nos. 2,116,685; 2,182,582; 2,634,420; 3,022,514; 3,860,967; 4,008,494; 4,653,119; 4,953,232; and 5,940,882. However, there remains a need to increase the longevity of dress shirts and the ease of using protective collar covers. Further, not all protective collar covers adequately protect dress shirts from the wear and fouling of dress shirt collars. Moreover, many collar covers suffer in the comfort department and hence their use is avoided.

The present invention addresses these issues—longevity, collar integrity, appearance, and comfort.

BRIEF DESCRIPTION

The collar protector of the invention is shaped to provide adequate coverage for the collar while having a symmetrical shape that facilitates and simplifies its use. The shape of the collar protector along with the materials used in its manufacture add to its comfort, aesthetics and resistance/repellency of stains. The stain resistant material eliminates neck rings, staining, oil fouling, and salt fouling. In addition, the materials and the shape can be selected to improve aesthetics and variety. Because the cover masks some or all of the shirt collar by its coverage, it can change the style of the shirt, changing it from a monochrome presentation to a two-tone effect. A blue dress shirt can be modified to have a white collar. A narrow collar can be turned into a wide one. The protective value of the cover is not lost; the same shirt can be used in more situations, even on the same day.

The inventive collar protector for a shirt covers both the neckband and outside flap portion of the collar and is removably attached thereto. Additionally, the inventive collar protector allows for decreased frequency of necessary dry cleaning or professional cleaning, while increasing longevity and the useful life of the shirt collar. Dirt and oil penetration is avoided.

The collar cover also can enhance the aesthetics of the shirt by providing contrasting color or texture, e.g. a blue shirt can be provided with a white collar, a textured fabric for the body shirt can be contrasted with a closely woven fabric for the collar, a polka-dot collar can be contrasted with striped shirt, etc. Variety can be introduced along with improved wear. The style variability offered by the collar changes increases the size of one's wardrobe.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

DETAILED DESCRIPTION

The following detailed description is directed to technologies for protecting one or more surfaces of a shirt collar. Utilizing the technologies described herein, a stain resistant collar protector may protect surfaces of a collar of a shirt, extend the longevity of the collar of the shirt, reduce the number of times a shirt must be professionally cleaned between uses, reduce the number of times a shirt must be professionally treated between uses, and is generally inexpensive and easy to apply to virtually any dress shirt. The stain resistant collar protector also introduces the possibility of varying the style of the shirt without loss of protective value. Color can be introduced as well as style changes. Wardrobe changes are possible with a change in the shape of the protector or its color. The protection coverage remains the same.

Figure 1:
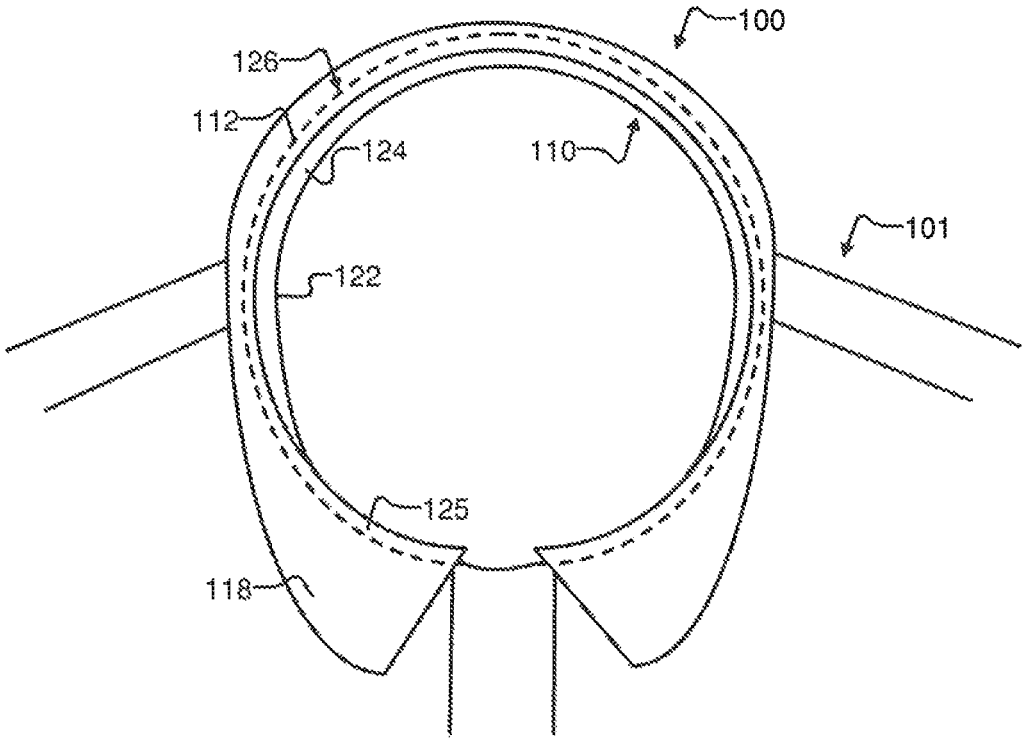
FIG. 1 is a schematic view of a shirt having a collar protector applied thereon, according to aspects of the concepts and technologies disclosed herein.
Figure 2:
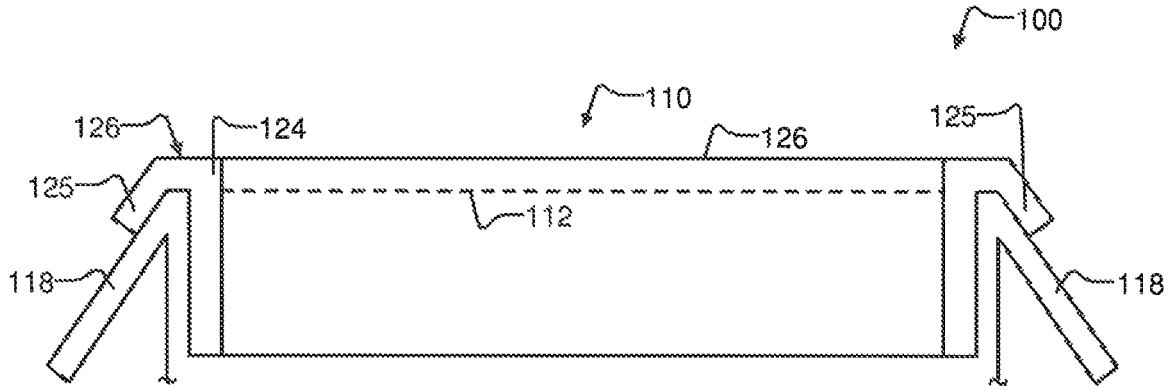
FIG. 2 is a cross-sectional view of the shirt and collar protector of FIG. 1.

Turning now descriptively to the drawings, in which similar reference characters denote similar elements throughout the several views, FIG. 1 and FIG. 2 illustrate a stain resistant collar protector 110 for a collar 100 of a shirt 101. The collar 110 has a neckband 122 and outside flap 118. The stain resistant collar protector 110 consists of a piece of thin stain resistant material having a longitudinal fold line 126 matching a neckband 122 fold line 112 extending along the periphery of the collar 100. One or more pressure sensitive adhesive areas 129, 141 (see FIG. 3) are arranged on the stain resistant collar protector 110 to allow removable attachment to the collar 100. The size, number and shape of the adhesive areas 129, 141 can be varied to achieve the desired degree of attachment. The degree of attachment depends on need and aesthetics. The shape of the collar protector 110 is roughly symmetrical about the longitudinal fold line 126. The protective collar cover is divided into two portions above the fold line 126, an inner 124 and outer portion 125. The width of the halves, H1 and H2, depends on the desired degree of coverage of the neckband 122 and the outer flap 118. The outer portion 125 can be extended to cover the entire outer flap. This can protect as well as provide a decorative effect. A desired protective for neck band 122 requires that inner portion 124 be coextensive with it and that the outer portion be sufficient to hold the collar protector 110 in place. The inner portion 124 of the stain resistant collar protector 110 protects the neckband 122 from being fouled by a wearer's neck and body. Furthermore, an outer portion 125 protects an outer flap 118 of the shirt collar 100 from fouling by a wearer's neck and body. The stain resistant protective collar 110 is positioned along the top (uppermost collar edge of outer flap 118) of the collar to be protected so that the longitudinal fold line 126 aligns with that edge.

The first portion 124 of the piece of stain resistant collar protector 110 can be removably attached to the inner surface of the neckband 122, fold over on the fold line 112 and the second portion 125 of the stain resistant collar protector 110 can be removably attached to outer surface of the outside flap to absorb dirt, salt, and/or moisture from the wearer of the shirt 101 to prevent soiling of the neck band 122 and outside flap of the collar.

Figure 3:
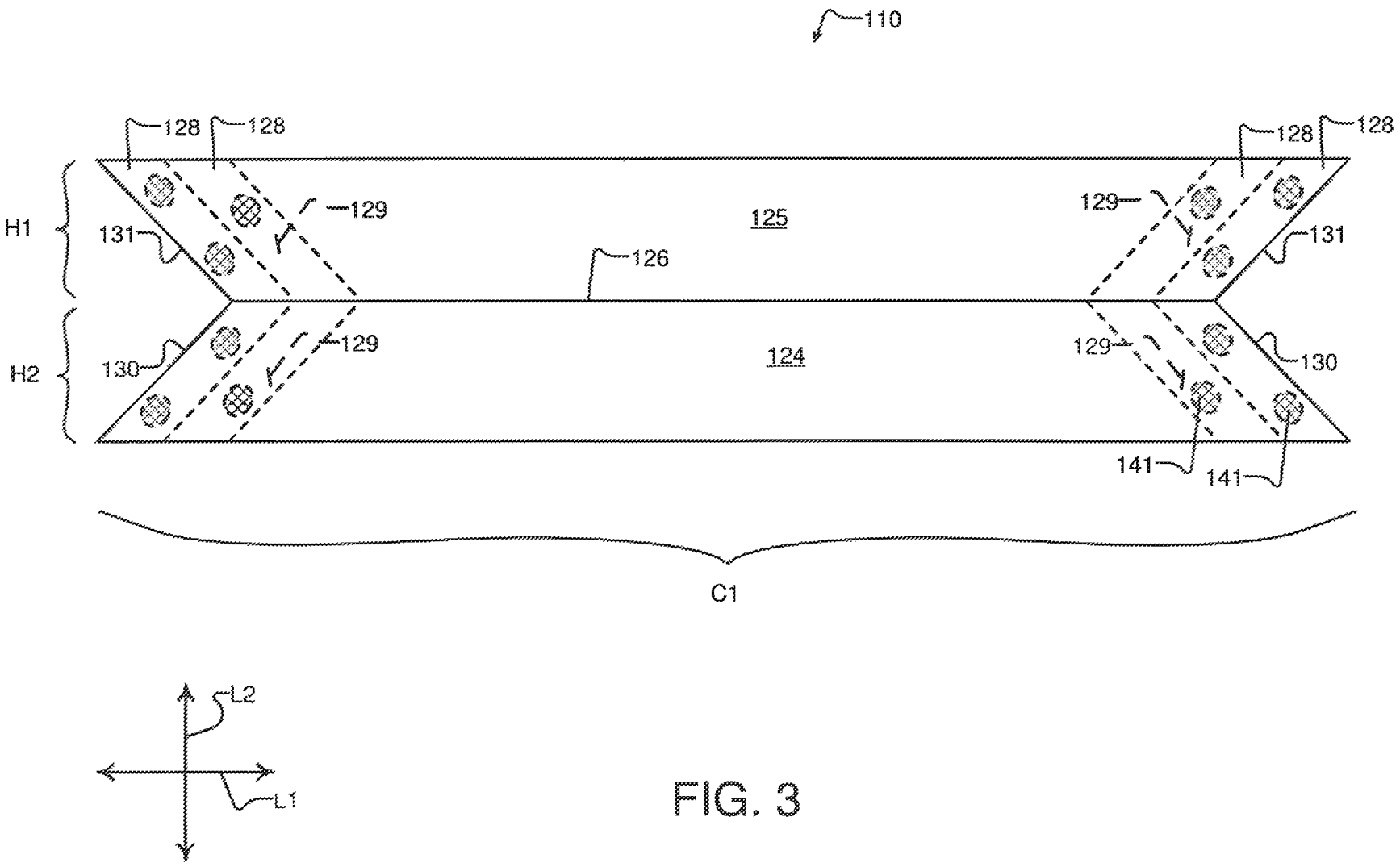
FIG. 3 is a plane view of a collar protector, according to aspects of the concepts and technologies disclosed herein.

FIG. 3 is a plan view of the stain resistant collar protector 110, according to aspects of the concepts and technologies disclosed herein. The plan view shows that the collar protector has symmetry about the longitudinal fold line 126. As shown, the stain resistant collar protector 110 includes a longitudinal axis L1 and a lateral axis L2. The stain resistant collar protector 110 extends longitudinally with a total dimension C1. Generally, C1 may be less than or equal to a circumference measurement of a shirt collar to which the stain resistant collar protector 110 is to be applied. It is noted that according to come implementations, the stain resistant collar protector 110 may be larger than a shirt collar, but may easily be trimmed to fit—coextensive with the outer flap 118.

The stain resistant collar protector 110 includes the first portion 124 and second portion foldably connected therebetween by longitudinal fold line 126. The longitudinal fold line 126 can terminate with oblique edges 130, 131, respectively. The oblique edges 130, 131 may be angled to match a shirt collar outer flap 118 angle, for example. Additionally, the oblique edges 130, 131 may be trimmed to match a desired shirt collar, as well.

The stain resistant collar protector 110 further includes adhesive portions. The size, shape and number of adhesive portions varies depending on need and aesthetics. As shown in FIG. 3, adhesive portion 128 is arranged thereon proximate with the oblique edges 130, 131. The adhesive portions may extend about the entire surface of the portions 124, 125. Accordingly, the adhesive portions may extend only within a more limited area of the portions 124, 125. Optionally, additionally, or in combination, the stain resistant collar protector 110 may also include adhesive areas 141 arranged thereon in any distribution desirable for attaching the stain resistant collar protector 110 to a collar 100 of a shirt 101.

Adhesive portions 128, 141 can be manufactured so that they are covered until needed and exposed by removing flaps 129. According to some embodiments, several oblique flaps can be included such that a first set of oblique flaps 129 is removed and the stain resistant collar protector 110 is applied to a first collar, removed, and subsequently applied to a second collar through removal of the additional oblique flaps 129. Other additional flaps covering adhesive areas may also be applicable. Moreover, more or fewer adhesive areas may also be applicable.

Generally, the stain resistant collar protector 110 can be formed of a stain resistant material. Additionally, the stain resistant collar protector 110 can be formed of clear material, plastic, vinyl, rubber, matching fabric, linen, pre-treated fabric, stain-treated fabric, paper and other suitable materials. The adhesive areas 128, 141 may include pressure sensitive adhesive, contact cement, glue, elastomeric adhesive, or any suitable adhesive. It is noted that the adhesive used may be repeatedly used under some implementations, Other implementations may include single-use adhesive.

Figure 4:
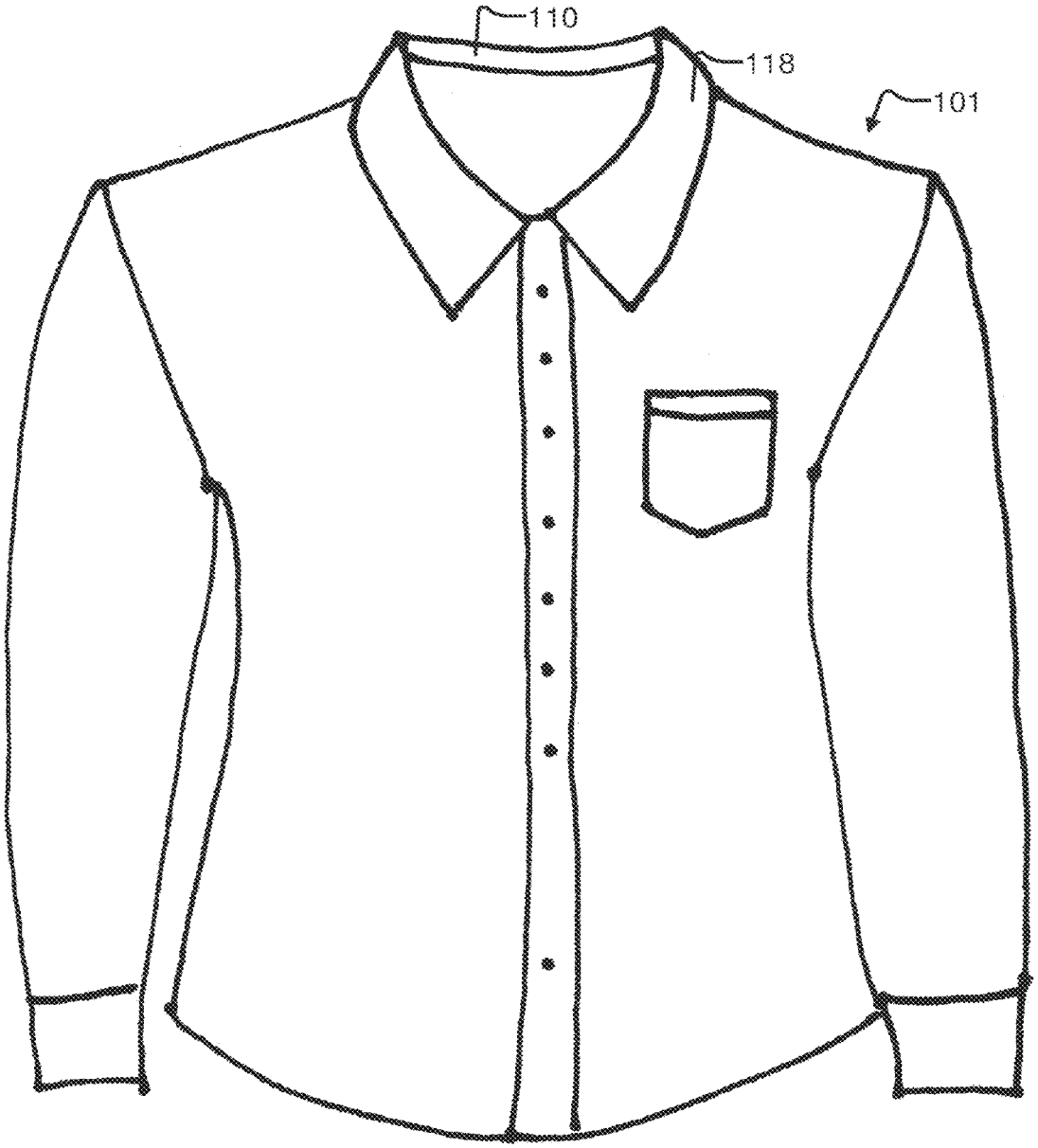
FIG. 4 is a front view of a shirt having a collar protector applied thereon, according to aspects of the concepts and technologies disclosed herein.

FIG. 4 is a front view of a shirt 100 having a stain resistant collar protector 110 applied thereon, according to aspects of the concepts and technologies disclosed herein. As illustrated, the stain resistant collar protector 110 is barely visible on an outer flap 118 of the collar 100. Accordingly, a user may wear the stain resistant collar protector 110 without detracting from an aesthetic of the shirt 101.

Figure 5:
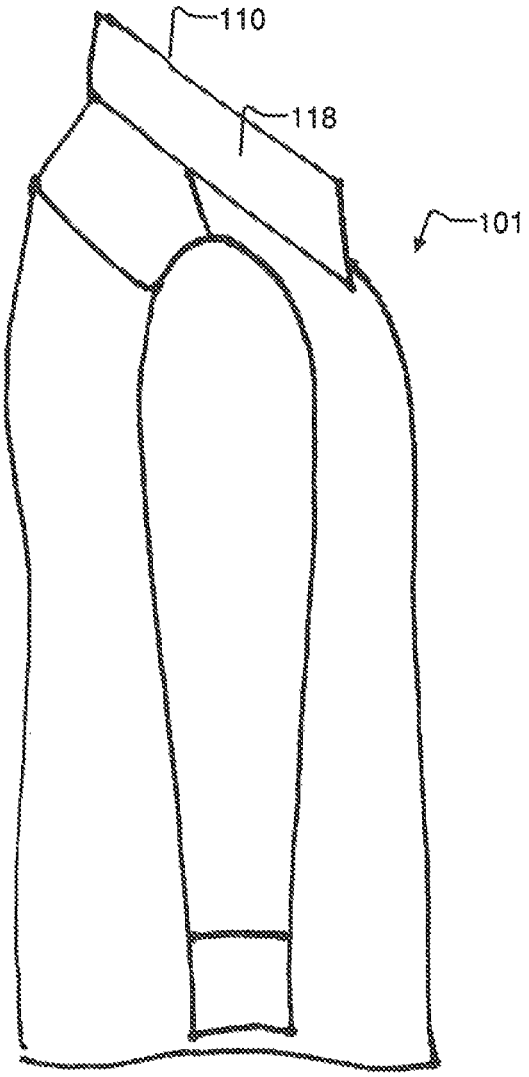
FIG. 5 is a side view of a shirt having a collar protector applied thereon, according to aspects of the concepts and technologies disclosed herein; and, FIG. 6 is a rear view of a shirt having a collar protector applied thereon, according to aspects of the concepts and technologies disclosed herein.

FIG. 5 is a side view of a shirt 101 having a stain resistant collar protector 110 applied thereon, according to aspects of the concepts and technologies disclosed herein. As illustrated, the stain resistant collar protector 110 is barely visible on an outer flap 118 of the collar 100. Accordingly, a user may wear the stain resistant collar protector 110 without detracting from an aesthetic of the shirt 101.

Figure 6:
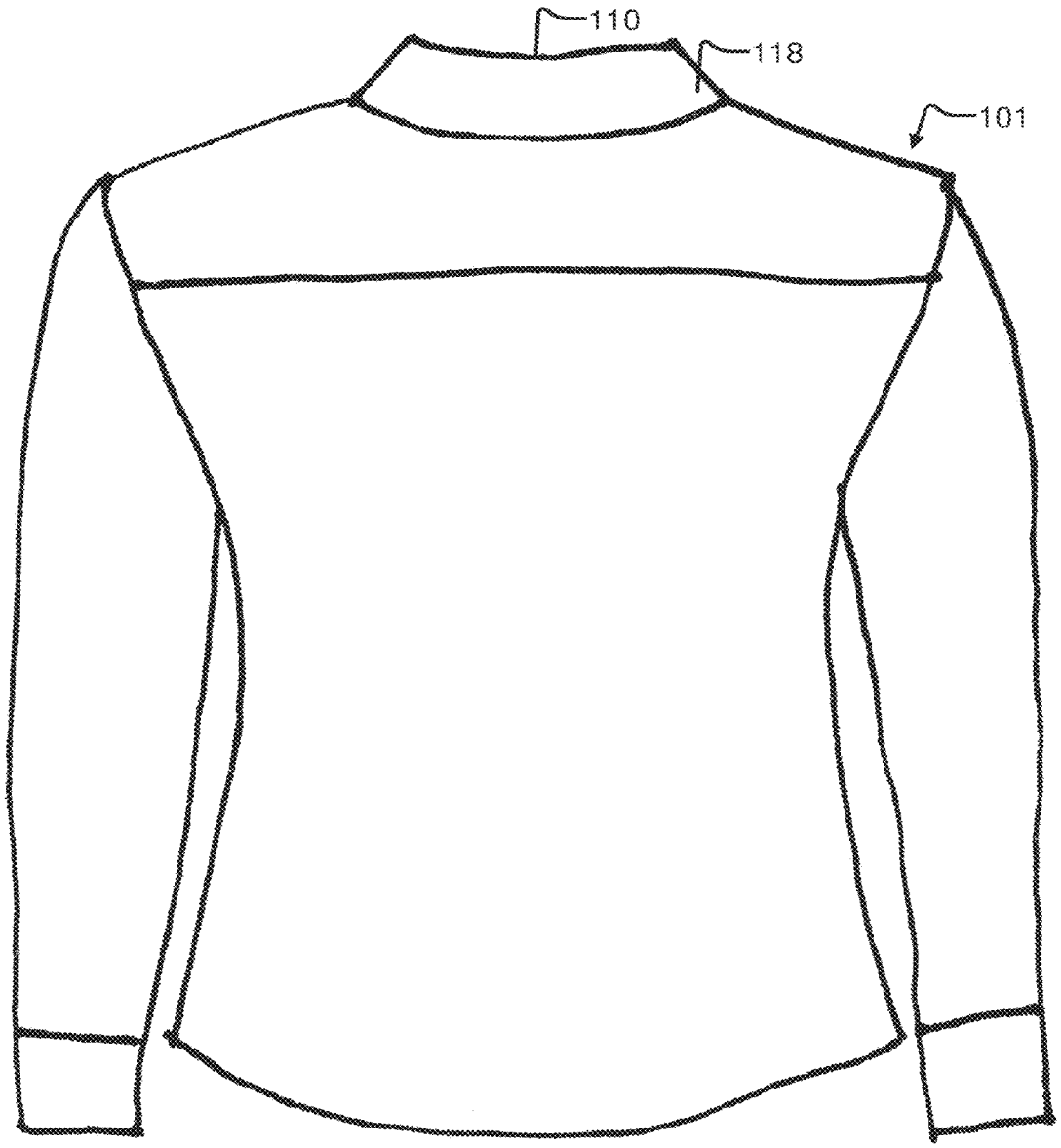

FIG. 6 is a rear view of a shirt 101 having a stain resistant collar protector 110 applied thereon, according to aspects of the concepts and technologies disclosed herein. As illustrated, the stain resistant collar protector 110 is barely visible on an outer flap 118 of the collar 100. Accordingly, a user may wear the stain resistant collar protector 110 without detracting from an aesthetic of the shirt 101.

Based on the foregoing, it should be appreciated that technologies for protecting shirt collars have been presented herein. Moreover, although the subject matter presented herein has been described in language specific to particular materials and adhesives, it is to be understood that the invention defined in the appended claims is not necessarily limited to the specific features, acts, or media described herein. Rather, the specific features, acts, and media are disclosed as example forms of implementing the claims.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the example configurations and applications illustrated and described, and without departing from the true spirit and scope of the present invention, which is set forth in the following claims.

We claim:

1. A shirt having a collar and a stain resistant collar protector, wherein the collar includes a neckband portion and an outside flap with angular spaced corners, wherein a collar fold line separates the neckband portion and the outside flap and wherein the stain resistant collar protector includes:

a piece of stain resistant material having a lateral axis and a longitudinal axis, with a longitudinal fold line that divides the piece of stain resistant material symmetrically into an inner first portion and an outer second portion, wherein the inner first portion includes a first end and a second end defining first and second oblique edges, and the outer second portion includes a first end and a second end defining third and fourth oblique edges, wherein the collar protector further includes a plurality of separate adhesive portions including a first adhesive portion proximate to the first oblique edge, a second adhesive portion proximate to the second oblique edge, a third adhesive portion proximate to the third oblique edge, and a fourth adhesive portion proximate to the fourth oblique edge, wherein the first adhesive portion proximate to the first oblique edge, the second adhesive portion proximate to the second oblique edge, the third adhesive portion proximate to the third oblique edge, and the fourth adhesive portion proximate to the fourth oblique edge position the inner first portion to cover the neckband portion of the collar and the outer second portion to cover all or a portion of the outside flap, wherein stain resistance is imparted to the covered neckband portion and the covered outside flap.

2. The shirt of claim 1, wherein the stain resistant material is fabric or plastic.

3. The shirt of claim 1, wherein the adhesive portions of the protector include a pressure sensitive adhesive.

4. The shirt of claim 1, wherein the adhesive portions of the protector include include a multiple use adhesive.

* * * * *